US008474216B1

(12) United States Patent
Goerner

(10) Patent No.: US 8,474,216 B1
(45) Date of Patent: Jul. 2, 2013

(54) METHOD AND APPARATUS FOR CONSTRUCTING DRILLING PLATFORMS WITHOUT DRIVEN PINS

(76) Inventor: Douglas C. Goerner, Spring, TX (US)

( * ) Notice: Subject to any disclaimer, the term of this patent is extended or adjusted under 35 U.S.C. 154(b) by 2849 days.

(21) Appl. No.: 10/822,280

(22) Filed: Apr. 8, 2004

Related U.S. Application Data

(60) Provisional application No. 60/461,540, filed on Apr. 9, 2003.

(51) Int. Cl.
*E04B 1/00* (2006.01)

(52) U.S. Cl.
USPC ..... 52/745.2; 52/650.05; 52/650.9

(58) Field of Classification Search
USPC ..... 52/651.01, 651.05, 651.06, 650.3, 52/648.1, 653.1, 656.9; 403/13, 14
See application file for complete search history.

(56) References Cited

U.S. PATENT DOCUMENTS 2,232,268 A * 2/1941 Rawson ..... 52/651.05
6,296,419 B1 * 10/2001 Millet et al. ..... 403/408.1
6,754,992 B1 * 6/2004 Byfield et al. ..... 52/36.5

* cited by examiner

*Primary Examiner* — William Gilbert
(74) *Attorney, Agent, or Firm* — Roy Kiesel Ford Doody & Thurmon

(57) ABSTRACT

A drilling platform constructed from columns of box support members. Each column has one or more spreader support brackets extending toward another spreader support bracket on an opposite column. Outwardly flaring locking arms rise from the spreader support brackets. A locking aperture is contained in the flared portion of each locking arm. The mouth of the aperture is preferably at about a thirty degree angle to its base so that the mouth is generally facing up. Spreader beams connect the columns. Each spreader beam has a locking pin at each end. The spreader beams are lowered onto the support arms of each column. As they are lowered, the locking pins are aligned to engage the locking apertures and thereby secure the spreader beams to the columns. Once the spreader beams are in place, a work platform can be built on top of the columns and spreader beams.

8 Claims, 6 Drawing Sheets

METHOD AND APPARATUS FOR CONSTRUCTING DRILLING PLATFORMS WITHOUT DRIVEN PINS

PRIORITY APPLICATIONS

This application claims priority of U.S. Provisional application 60/461,540, filed on Apr. 9, 2003, and which is hereby incorporated by reference in its entirety.

BACKGROUND OF THE INVENTION

1. Field of the Invention

This invention relates to drilling platforms in general and drilling platform assemblies in particular.

2. Prior Art

Drilling platforms typically include a one or more box support members. The box support members are usually rectangular steel frameworks. Two or more box support members will often be stacked one upon the other until a desired height is reached. These box supports will be arrayed in parallel columns, leaving a gap between them. The gap will generally include the center line of the well being drilled or serviced. Thus, it is important that the support structure not obstruct the center line of the well. However, it is equally important that the structure be capable of supporting the tools and equipment that are used to work over the well.

To provide the requisite support while leaving the desired gap open, spreader beams spanning the gap are used to connect the parallel columns of box support members. The spreader beams are typically substantial steel girders. Together the spreader beams and the box support columns create a foundation on which a drilling or work platform may be constructed. Once the foundation is in place, heavy oil field equipment may be supported upon the platform.

Spreader beams are currently installed using a system of driven pins and apertures. Holes are contained in each end of the spreader. Matching holes are provided in the box support members. Spreader beams are raised into place with a crane. The holes must be physically aligned by workers who then drive the pins. There is very little tolerance for error in this process, as the alignment of the apertures must be precise. The necessary precision makes for tedious and repetitive adjustments with a crane, raising and lowering the spreader beams until the apertures are aligned precisely. While this is taking place, the workers driving the pins must be in the vicinity of the apertures to guide the crane operator and to physically guide the spreader beams into place. The required proximity of the workers to and frequent physical contact with the moving steel girders places the workers at risk for injury.

Drilling rigs are typically rented by the day, at rates of many thousands of dollars per day and up. Thus, excessive amounts of time spent constructing the platform foundation can be costly. Additionally, the high labor requirements of prior art platform construction increases the cost of erecting drilling and service rigs. Therefore, a drilling platform and methods of erecting the same meeting the following objectives is desired.

OBJECTS OF THE INVENTION

It is an object of the invention to provide a drilling platform assembly that can be erected rapidly.

It is a further object of the invention to provide a drilling platform assembly that can be erected with a minimum amount of manpower.

It is a still further object of the invention to provide a drilling platform that can be erected safely.

It is yet another object of the invention to provide a drilling platform that can be erected economically.

It is still another object of the invention to provide a drilling platform that can be erected securely.

SUMMARY OF THE INVENTION

The invention comprises a drilling platform assembly having at least two support columns. The support columns are formed from one or more box support members. The box support members are preferably rectangular steel frameworks configured to support substantial amounts of weight. Where more than one box support member comprises a support column, the box support members are stacked with a crane to the desired height.

At least one of the box support members in each support column contains a spreader support bracket. The spreader support bracket extends outward from the support column toward the opposite support column. Another spreader support bracket extends from a box support member in the opposite support column. These two spreader support brackets are aligned with each other. Each pair of support columns may have several such spreader support bracket pairs.

Each spreader support bracket will preferably contain a spreader support surface and a locking arm. The spreader support surface will be positioned to be generally parallel to the ground. The locking arm will preferably be generally perpendicular to the ground. The locking arm will contain a locking aperture. In the preferred embodiment, a pair of locking arms will be provided to engage the spreader beam on both sides.

The support columns will be connected with one or more spreader beams. In the preferred embodiment, the spreader beams will be essentially comprised of steel beams or girders. The spreader beams contain locking pins at each end. A lifting device such as a crane, a gin pole truck, or a fork lift will lift the spreader beams and deposit them on the spreader support surface of the spreader support bracket. The locking pins will engage the locking apertures, thereby securing the spreader beam to the box support members that make up the support columns. Of course, it will be appreciated that the male and female members may be reversed so that the locking pins are positioned on the locking arms and the locking apertures are contained in the spreader beam.

Once the spreader beams are in place, a work platform may be installed over the support columns and the spreader beams. The heavy equipment and machinery may then be installed to conduct drilling or well servicing operations, with the space beneath the spreader beams opened or left open as needed to provide access to the well.

DETAILED DESCRIPTION OF THE BEST MODE OF THE INVENTION

Figures 1, 3:
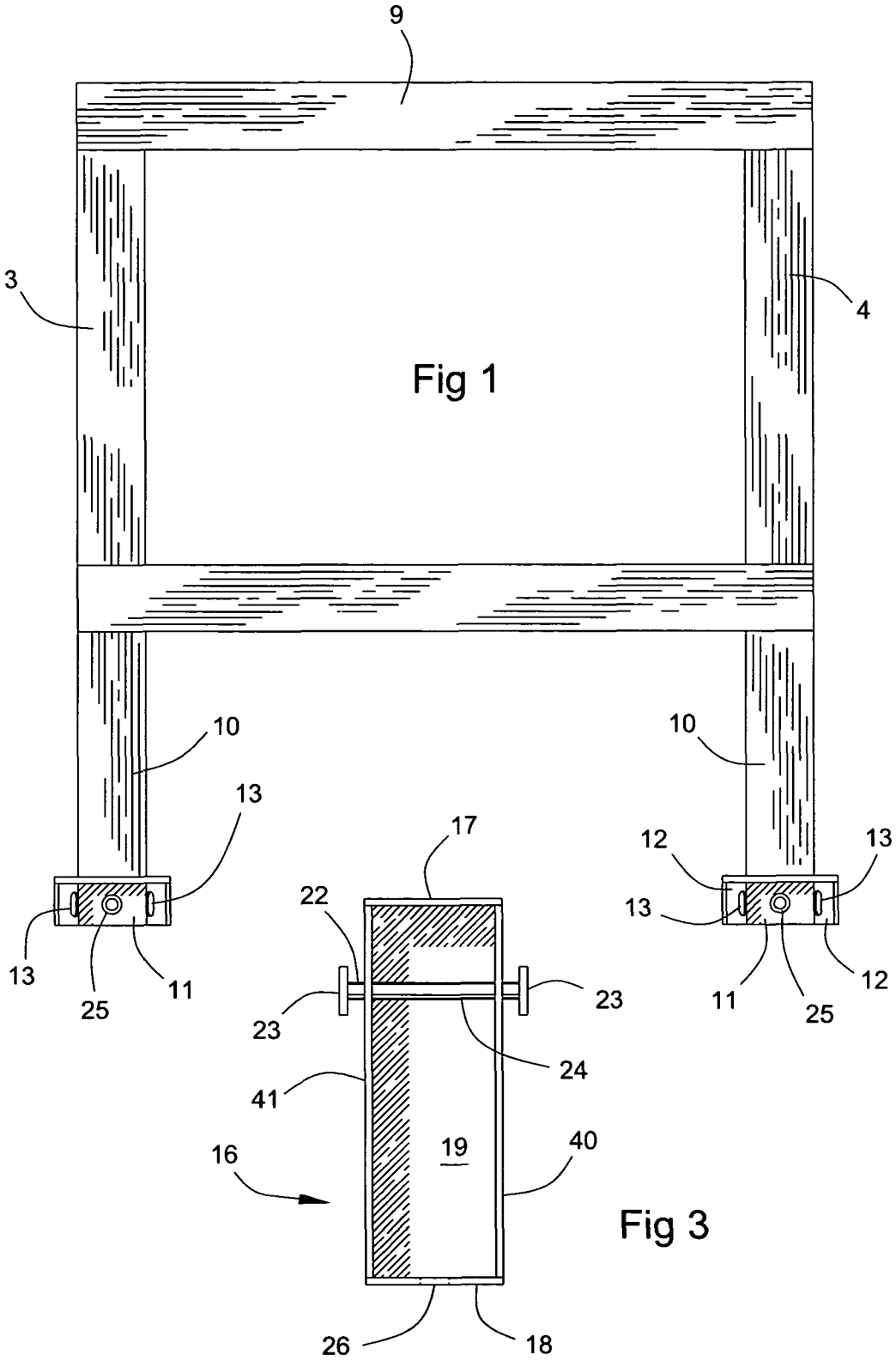
FIG. 1 is a top view of a preferred embodiment of a box support member.
FIG. 3 is an end view of a preferred embodiment of a spreader beam.
Figure 2:
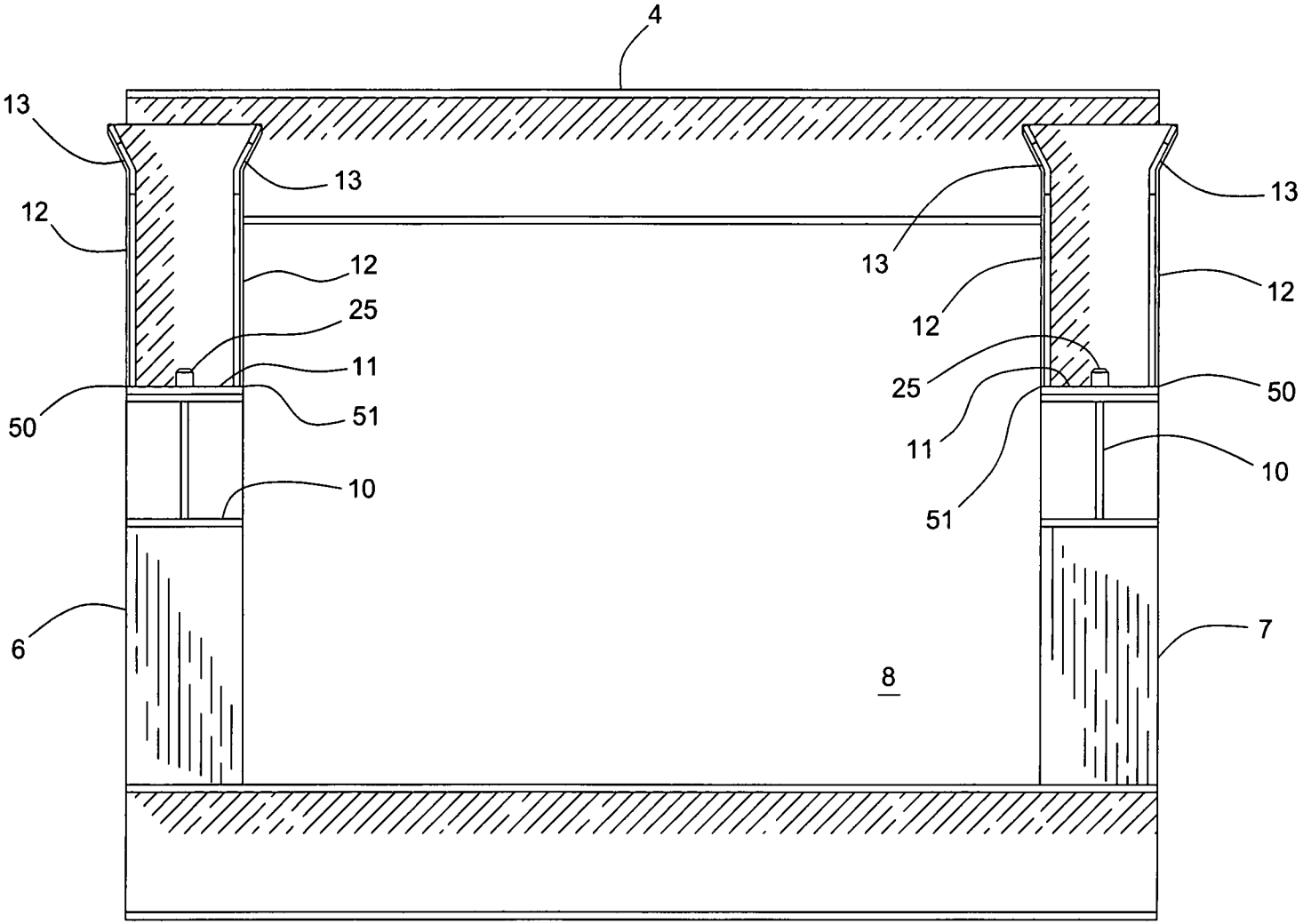
FIG. 2 is an end view of a preferred embodiment of a box support member.
Figure 4:
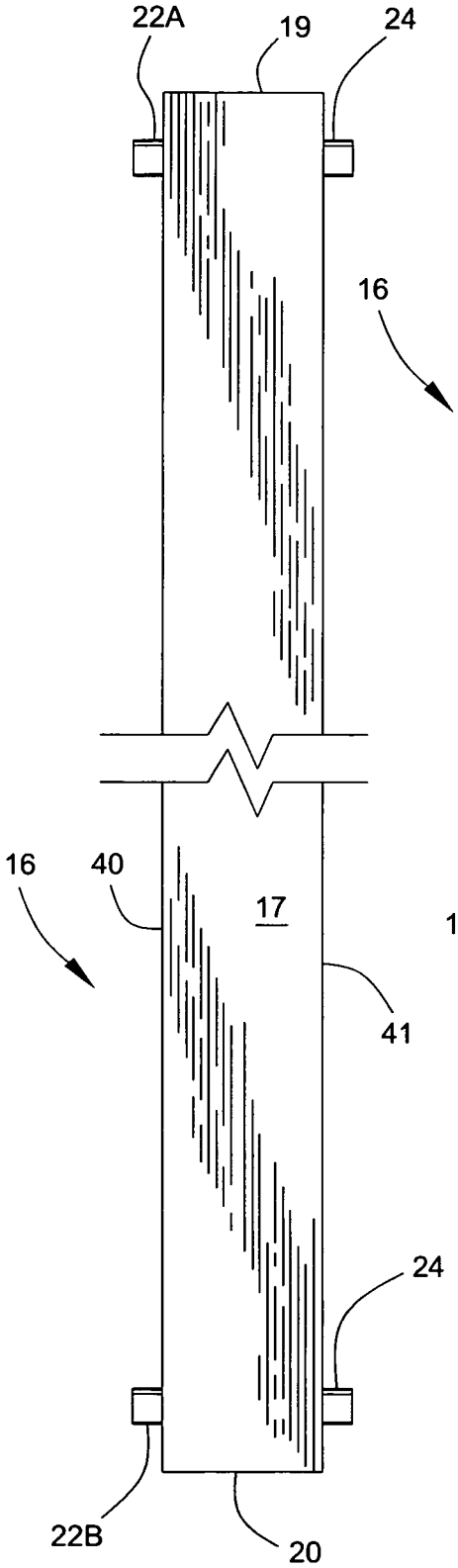
FIG. 4 is a top view of a preferred embodiment of a spreader beam.
Figure 5:
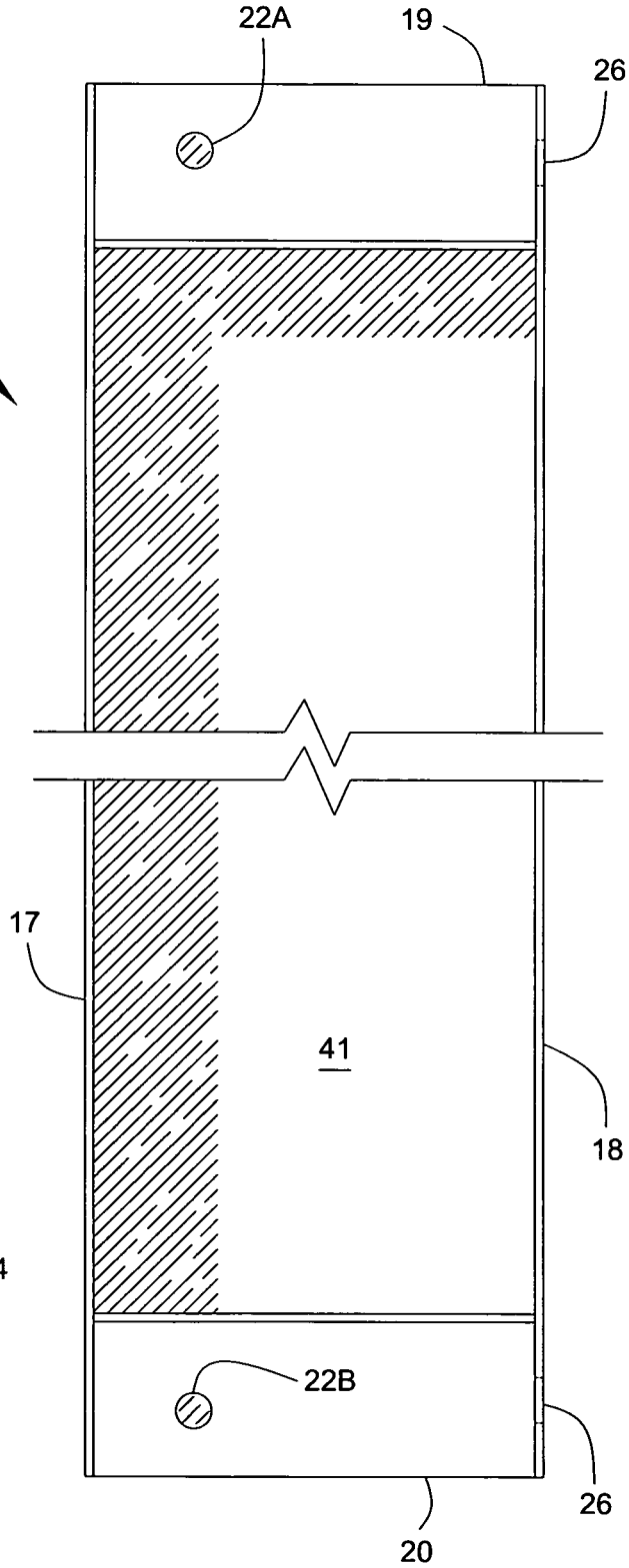
FIG. 5 is a side view of a preferred embodiment of spreader beam.
Figure 6:
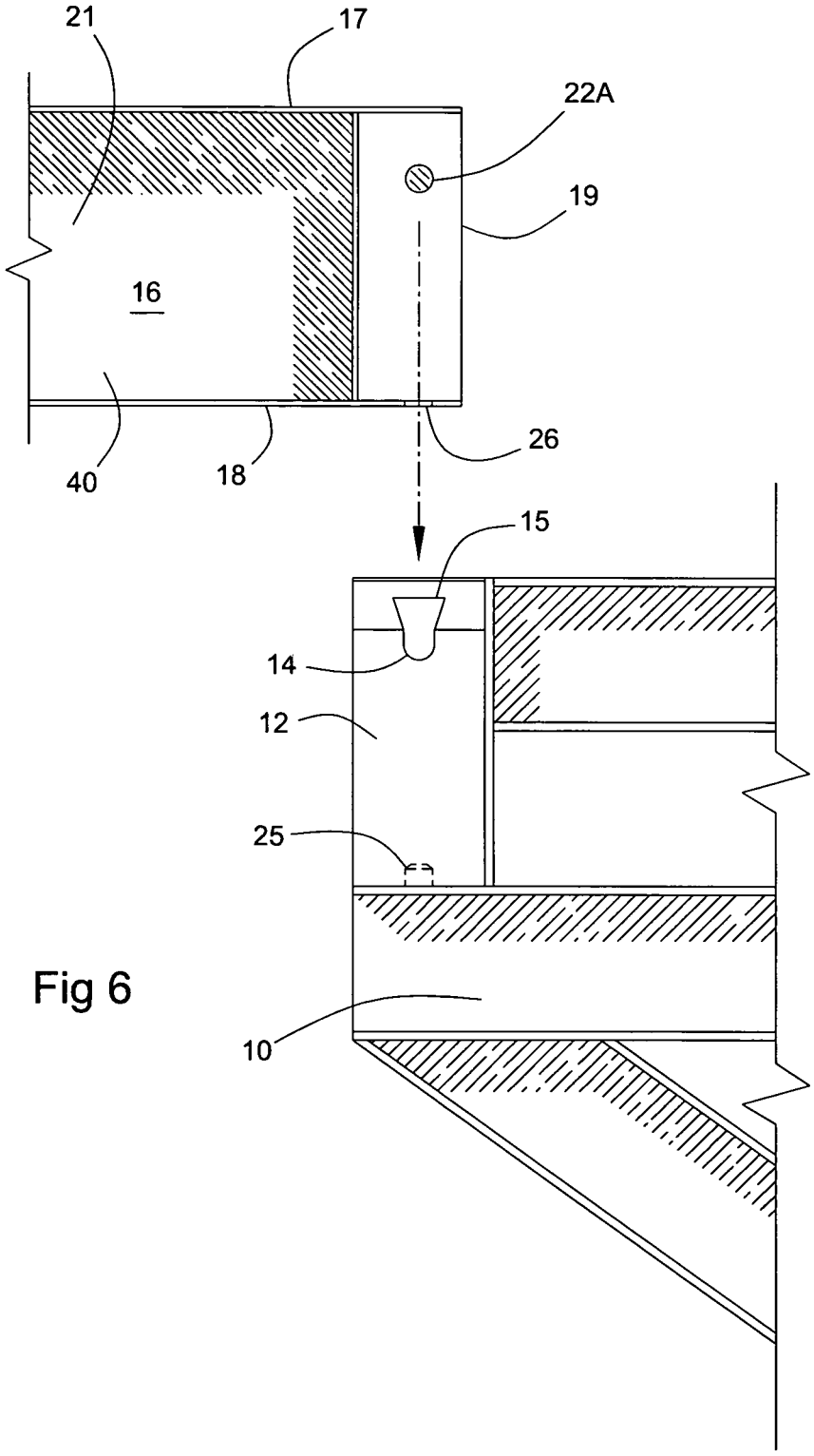
FIG. 6 is a side view illustrating the connection between a spreader beam and a spreader support bracket.
Figure 7:
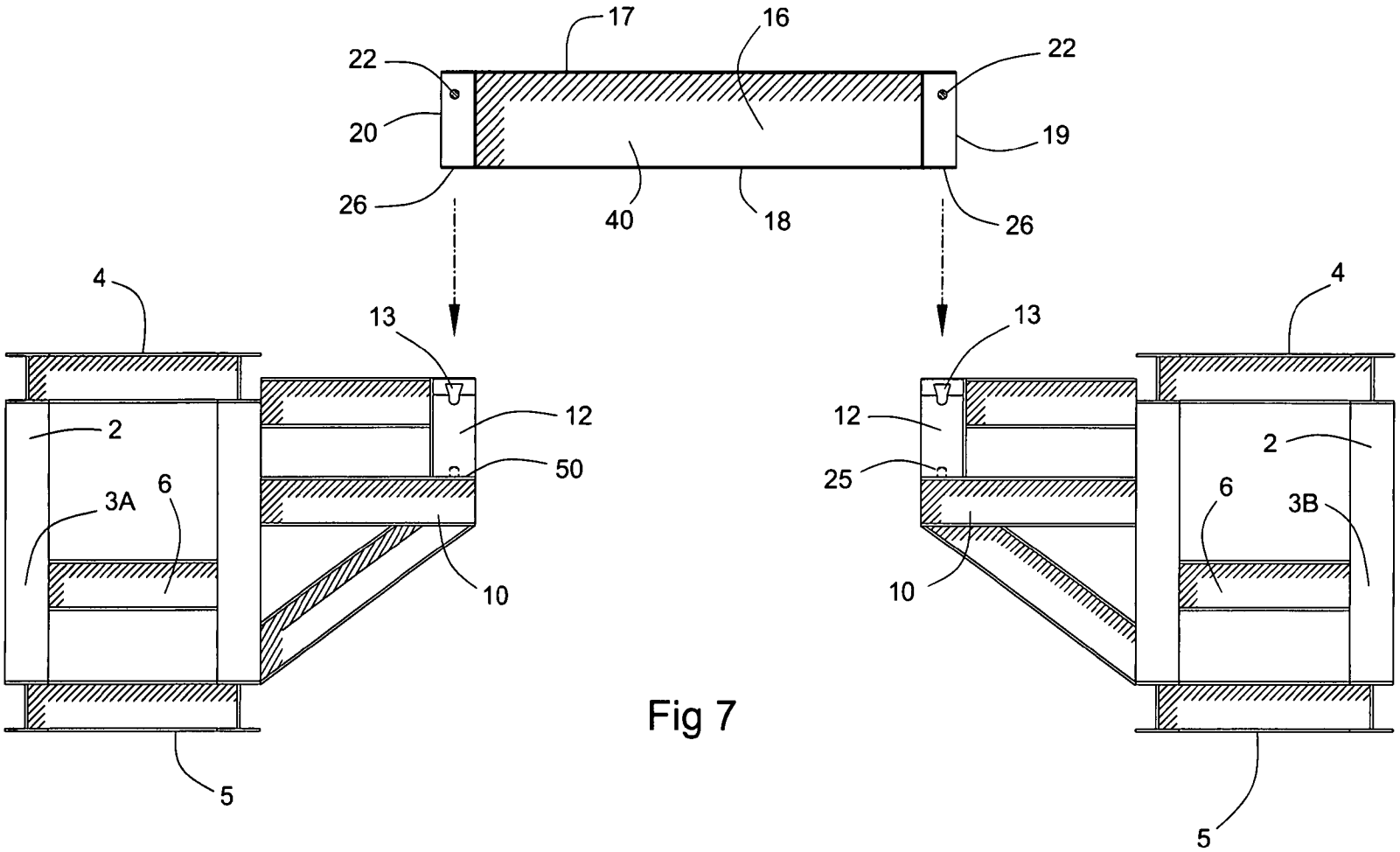
FIG. 7 is a side view of a preferred embodiment of a spreader beam being lowered into engagement with a pair of spreader support brackets.
Figure 8:
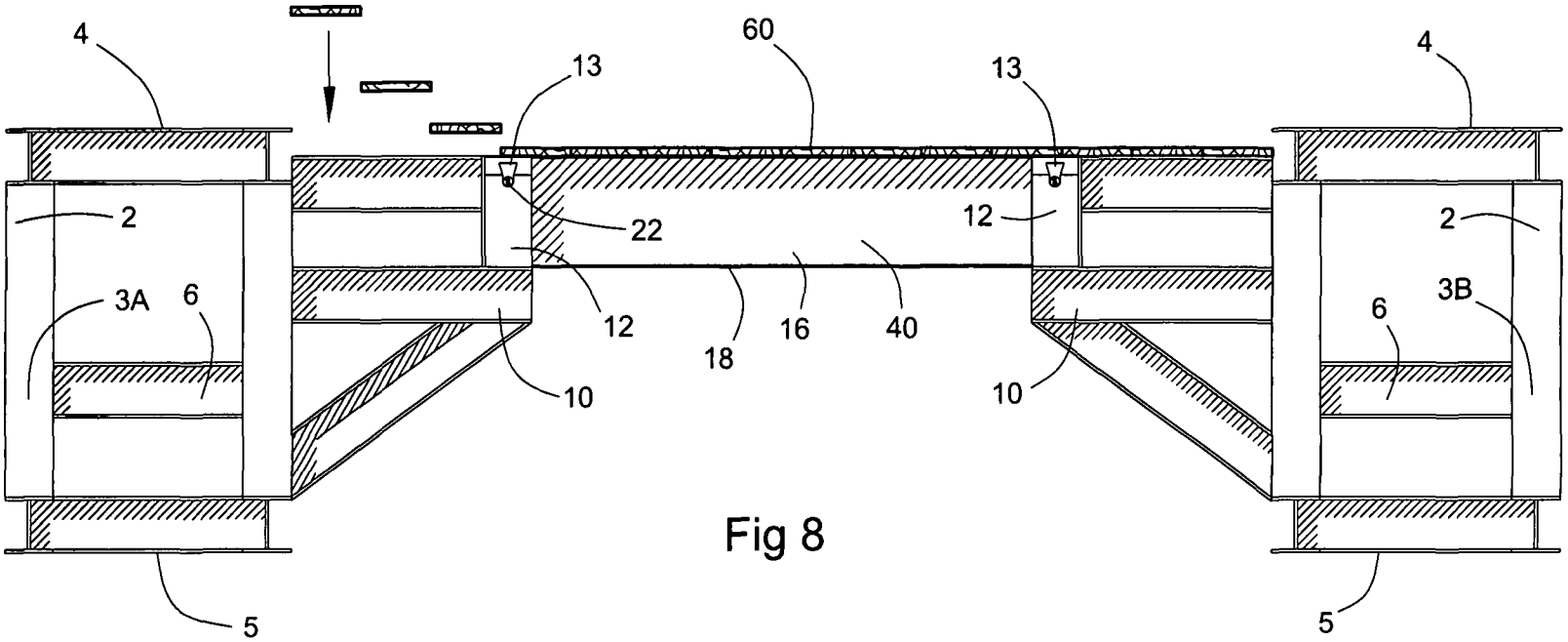
FIG. 8 is a side view of a preferred embodiment of a drilling platform constructed from the connection of two box support members joined by spreader beams.

The preferred embodiment of the invention comprises a drilling platform 1. The drilling platform is comprised of one or more support columns 2. Each support column 2 is comprised of one or more box support members 3. In the preferred embodiment, first and second box support members 3A and 3B are rectangular structures having an upper surface 4 and an opposite lower surface 5. Box support member 3 preferably also has a first end 6 and a second end 7 located opposite first end 6, each end 6, 7 positioned substantially perpendicular to upper surface 4 and lower surface 5. Sides 8 extend between ends 6, 7. Box support member 3 is preferably made of steel beams that have been welded or bolted together to create a load bearing frame 9. Box support members 3 as well as the other components of the invention will need to support substantial amounts of weight. Accordingly, the various components of the present invention should preferably be constructed of 50 ksi or higher steel or similar high strength materials (1 ksi, a measure of yield strength, equals 1000 pounds per square inch or psi).

Support columns 2 may be constructed of a single box support member 3 or by stacking two or more box support members 3 together. Box support members 3 may be stacked one on top of the other and then bolted or welded together or joined by other conventional means.

In the preferred embodiment, at least one spreader support bracket 10 extends substantially perpendicularly from one of sides 8 of each box support member 3. Spreader support bracket 10 preferably comprises a spreader support surface 11 and at least one locking arm 12. Locking arm 12 may extend generally perpendicular or upward from or relative to support surface 11 or locking arm 12 may extend generally perpendicular from or relative to box support member 3. In the preferred embodiment, each spreader support bracket 10 will comprise a pair of substantially parallel locking arms 12 extending from the front side 50 and rear side 51 of spreader support bracket 10 and sized and positioned to contain spreader beam 16 between them. Spreader support bracket 10 should preferably be made of 50 ksi or stronger steel and be configured to support a substantial weight.

Each spreader support bracket 10 should preferably contain a locking aperture 13. In the preferred embodiment, a locking aperture 13 is contained in each locking arm 12. Locking aperture 13 has a base end 14 and a mouth end 15. In the preferred embodiment, base end 14 is located below mouth end 15. Mouth end 15 is preferably wider than base end 14. In the preferred embodiment, base end 14 is about eight inches wide and mouth end 15 is about sixteen inches wide. Locking apertures 13 will preferably taper about 15° to 20° from base end 14 to mouth end 15.

In the preferred embodiment, locking arm 12 is curved or flared through the section containing locking aperture 13. This curvature will position mouth end 15 at an angle of approximately 30° to base end 14. In the preferred embodiment, mouth end 15 will be offset about two inches from base end 14. This offset will make it easier to insert objects into locking aperture 13 from above.

One or more spreader beams 16 connect support columns 2. Spreader beams 16 are preferably high strength steel beams of about thirteen to fourteen feet in length. They will vary in thickness and in height depending upon the loads to be carried. Spreader beams 16 are preferably made from 50 ksi or higher steel. Spreader beams 16 have an upper surface 17 and a lower surface 18 opposite upper surface 17. Spreader beams also have a first end 19 opposite a second end 20 and a front surface 40 opposite a rear surface 41. In the preferred embodiment, front surface 40 and rear surface 41 are generally perpendicular to upper surface 17 and lower surface 18. When spreader beams 16 are in place between columns 2, front surface 40 and rear surface 41 will be substantially vertically oriented—that is, perpendicular to the ground. A load bearing structure 21 extends between first end 19 and second end 20.

Spreader beams 16 are preferably provided with a first and second locking pin 22 A and B at each end 19, 20 of spreader beam 16, although additional locking pins could be provided if desired. Locking pins 22 are preferably made of 95 ksi or higher steel. Locking pins 22 preferably extend substantially perpendicularly from front and rear surfaces 40, 41 of spreader beams 16, and may be attached to spreader beams 22 by welding, threaded mating, frictional insertion, or any other conventional means suitable for transmitting loads from locking pin 22 to spreader beam 16.

In the preferred embodiment, locking pins 22 are straight. However, in one embodiment, locking pins 22 may comprise two head ends 23 distal from spreader beam 16 and a shaft 24 extending between head ends 23 through spreader beam 16. Head ends 23 are preferably wider than shaft 24. When head ends 23 are used, head end 23 and shaft 24 are sized relative to locking aperture 13. In particular, head end 23 should be narrow enough to pass through mouth end 15 of locking aperture 13 but too wide to pass through base end 14 of locking aperture 13. Whether head ends 23 are used or not, shaft 24 should be narrow enough to pass through base end 14, but preferably only just narrow enough, so that locking pin 22 will rest securely at the bottom of locking aperture 13.

Lower surface 18 of spreader beam 16 is configured to rest upon spreader support surfaces 11 of two spreader support brackets 10. The weight of spreader beam 16 should preferably be borne by spreader support brackets 10, not locking pins 22. To accomplish this, locking pins 22 should preferably be positioned on spreader beam 16 so that locking pins 22 will not reach base end 14 of locking aperture 13 before lower surface 18 of spreader beam 16 is resting on spreader support surfaces 11 of spreader support brackets 10.

In the preferred embodiment, support surfaces 11 are provided with a coupling pin 25. Coupling pin 25 should preferably be made of 95 ksi or higher steel. Coupling pin 25 should preferably extend substantially perpendicularly from support surfaces 11. Lower surface 18 of spreader beam 16 will preferably be provided with a coupling aperture 26 sized and positioned to receive coupling pin 25. Preferably, a mated pair of coupling pin 25 and coupling aperture 26 will be provided at each end 19, 20 of spreader beam 16 and the corresponding support surfaces 11, although additional mated pairs may be provided if desired. Coupling pin 25 and coupling aperture 26 will further secure spreader beam 16 to spreader support bracket 10. Coupling pins 25 and coupling apertures 26 may be used in addition to locking pins 22 and locking apertures 13. Alternatively, particularly with shorter spreader beams 16, coupling pins 25 and coupling apertures 26 may be used in lieu of locking pins 22 and locking apertures 13. Although coupling pins 25 have been described as being integral with support surfaces 11 and coupling apertures 26 have been described as being integral with spreader beams 16, coupling apertures 26 may be incorporated into support surfaces 11 and coupling pins 25 may be added to spreader beams 16.

In operation, cranes are used to position box support members 3 at the well site. Box support members 3 will be positioned on the ground parallel to one another. Operators will place shims under box support members 3 as needed until box support members 3 are substantially level. Once level, additional box support members 3 may be stacked upon the ground level box support members 3 until the desired height is reached. Each stack of one or more box support members 3 will form a support column 2. Spreader support brackets 10 will extend from one or more of the box support members 3 comprising each support column 2, so that support arms 10 are aligned with each other in pairs. Cranes will then lower spreader beams 16 into releasable connection with spreader support brackets 10. As spreader beams 16 are lowered, locking pins 22 will be aligned with mouth end 15 of locking aperture 13. As spreader beams 16 are lowered, mouth ends 15 of locking apertures 13 will guide locking pins 22 into locking apertures 13. This will also simultaneously align spreader beams 16 with the underlying spreader support surfaces 11 of the spreader support brackets 10. It will also align coupling pins 25 with the corresponding coupling apertures 26 when coupling pins 25 are used. Once spreader beams 16 are resting on the spreader support brackets 10, the locking arms 12 will prevent the spreader beams 16 from moving laterally in either one direction, while the heads 23 of locking pins 22 will engage the locking apertures 13 and secure beams 16 to locking arms 12. Coupling pins 25 and coupling apertures 26 will perform this function as well. Spreader support brackets 10 will support the spreader beams 16 from below and gravity will keep them from rising. Thus, by simply, but carefully, dropping the spreader beams 16 onto the spreader support brackets 10, the spreader beams 16 may be fully secured to the box support members 3 and to the support columns 2. In this way, much time, manpower, and money may be saved while simultaneously reducing the risk of injury to workers constructing the drilling platform.

Once the spreader beams 16 are installed, a work platform 60 may be constructed over the upper surfaces 4, 17 of box support members 3 and spreader beams 16, and the work of the platform performed—typically performing work on a petroleum well below platform 60. Once drilling or other work is complete, platform 60 will be disassembled. During disassembly, the spreader beams 16 may be removed simply by lifting them from spreader support brackets 10 with a crane. Thus, the present invention will expedite work platform breakdown as well as erection.

Construction and disassembly can be performed even more quickly if work platform 60 built over spreader beams 16 is left whole. In such cases, work platform 60 may simply be removed from spreader beams 16 with a crane in one step. Alternatively, if work platform 60 is left intact and attached to spreader beams 16, the entire work platform 60 and all spreader beams 16 may be lifted off in one step, provided a crane of adequate lifting power is available.

The present invention will greatly enhance the rate at which drilling platforms 1 are erected and disassembled. Comparable platforms that took ten to twelve hours to erect or take down with driven pins are now expected to take about four hours to erect or disassemble. Moreover, in the present invention, no one will have to be near the joints between spreader beams 16 and support members 3 to drive pins as spreader beams 16 are raised or lowered, reducing the risk of injury during assembly and disassembly. Thus, the present invention will provide safer as well as faster erection and disassembly when compared to the prior art.

Although the invention has been described in terms of its preferred embodiment, other embodiments will be apparent to those of skill in the art from a review of the foregoing. Those embodiments as well as the preferred embodiments are intended to be encompassed by the scope and spirit of the following claims.

I claim:

1. A method of erecting a drilling platform comprising:

positioning a first box support member comprising a load bearing frame and a first spreader support bracket, said first spreader support bracket comprising a first spreader support surface and at least one locking aperture having a mouth end and a base end opposite a second box support member comprising a load bearing frame and a second spreader support bracket comprising a second spreader support surface and at least one locking aperture so that said first spreader support bracket and said second spreader support bracket face one another;

lowering a load bearing spreader beam comprising a first end opposite a second end and a front surface opposite a rear surface, said front surface and said rear surface each having a substantially vertical orientation, and a locking pin extending from said spreader beam substantially perpendicular to said front surface of said spreader beam onto said first and second spreader support brackets, said locking pin positioned to engage one of said locking apertures as said spreader beam is lowered.

2. A method of erecting a drilling platform according to claim 1 wherein at least one of said spreader support brackets contain at least two locking apertures each having a mouth end and a base end, and wherein said at least one spreader support bracket comprises at least two locking arms, said locking arms positioned on each side of said at least one spreader support bracket, said locking arms each containing at least one of said locking apertures, and wherein said locking pin extends from said front surface and said rear surface of said spreader beam and wherein the method further comprises lowering said spreader beam between said locking arms, said locking arms, said locking apertures, and said locking pin all positioned to allow said locking pin to engage said locking apertures in said locking arms as said spreader beam is lowered.

3. A method of erecting a drilling platform according to claim 2 wherein said mouth ends of said locking apertures are wider than said corresponding base ends of said locking apertures.

4. A method of erecting a drilling platform according to claim 3 wherein said locking pin further comprises two ends, a shaft extending therebetween, and a head affixed to each end, said heads being wider than said shaft, said heads and said shaft sized to pass through said mouth ends of said locking apertures as said spreader beam is lowered and said heads sized to prevent them from passing through said locking apertures after said spreader beam is lowered onto said spreader support brackets.

5. A method of erecting a drilling platform according to claim 4 wherein said mouth ends of said locking apertures are offset relative to said corresponding base ends.

6. A method of erecting a drilling platform according to claim 1 wherein at least one of said spreader support brackets further comprises a coupling pin extending upward said spreader support bracket and wherein said lower surface of said spreader beam contains at least one coupling aperture sized and positioned to receive said coupling pin as said spreader beam is lowered onto said spreader support brackets.

7. A method of erecting a drilling platform according to claim 1 further comprising mounting a plurality of spreader beams between said first and second box support members.

8. A method of erecting a drilling platform according to claim 7 further comprising mounting a work platform over said plurality of spreader beams.

* * * * *